United States Patent [19]

Trame

[11] 3,939,584

[45] Feb. 24, 1976

[54] DISPLAY WITH INTERLOCKING STRIPS

[75] Inventor: Charles E. Trame, Milwaukee, Wis.

[73] Assignee: Everbrite Electric Signs, Inc., South Milwaukee, Wis.

[22] Filed: Oct. 29, 1974

[21] Appl. No.: 518,560

[52] U.S. Cl. ..... 40/10 R; 40/78; 40/142 R

[51] Int. Cl.[2] ..... G09F 3/18

[58] Field of Search ..... 40/63 R, 64 R, 86 R, 140, 40/142 R, 10 R, 78, 78.05, 117

[56] References Cited

UNITED STATES PATENTS

| | | | |
|---|---|---|---|
| 3,159,937 | 12/1964 | Barnes | 40/86 R |
| 3,660,918 | 5/1972 | Bourseau | 40/64 R |

*Primary Examiner*—John H. Wolff

*Attorney, Agent, or Firm*—Arthur L. Morsell, Jr.

[57] ABSTRACT

A plurality of elongated opaque holders with elongated openings therein are removably connected together at their longitudinal edges by light excluding joints, there being a light source behind the interconnected holders. Opaque strips bearing translucent indicia are removably connected to the holders over the openings. The indicia may specify items of merchandise. Pre-curled plastic film tapes bearing numbers are movably mounted at one end of each opaque strip to display the price for the item. The pre-curled tapes are mounted behind holder portions having window openings through which the numbers are visible and through which the pre-curled tapes can be manually contacted to conveniently change the prices.

7 Claims, 10 Drawing Figures

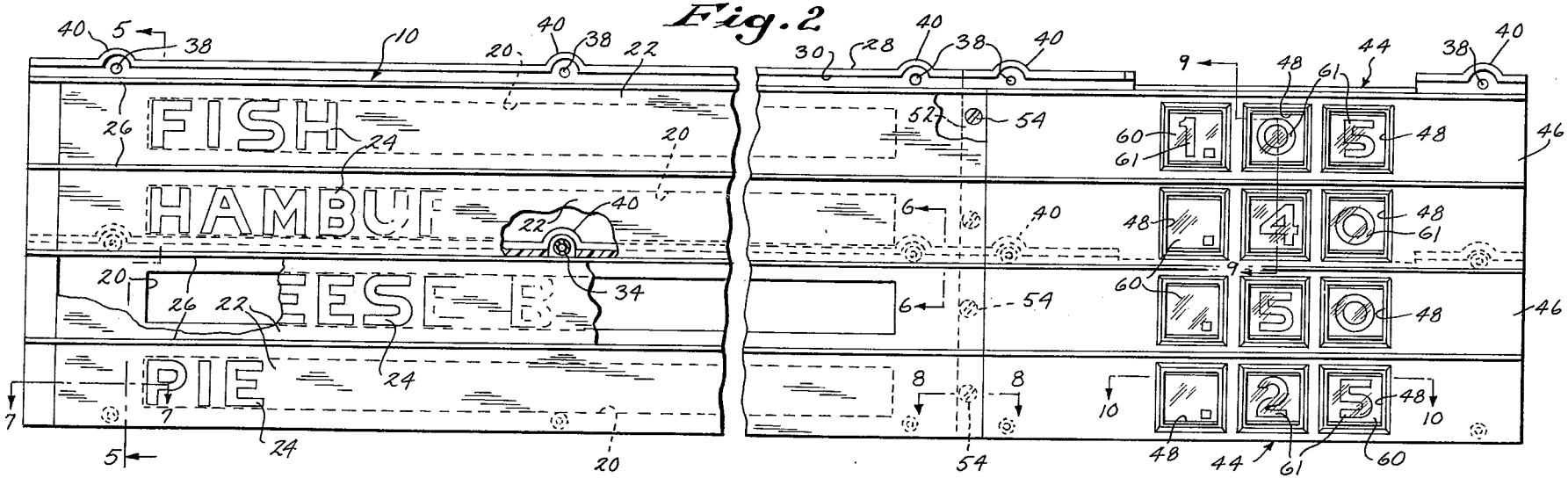
Fig. 2
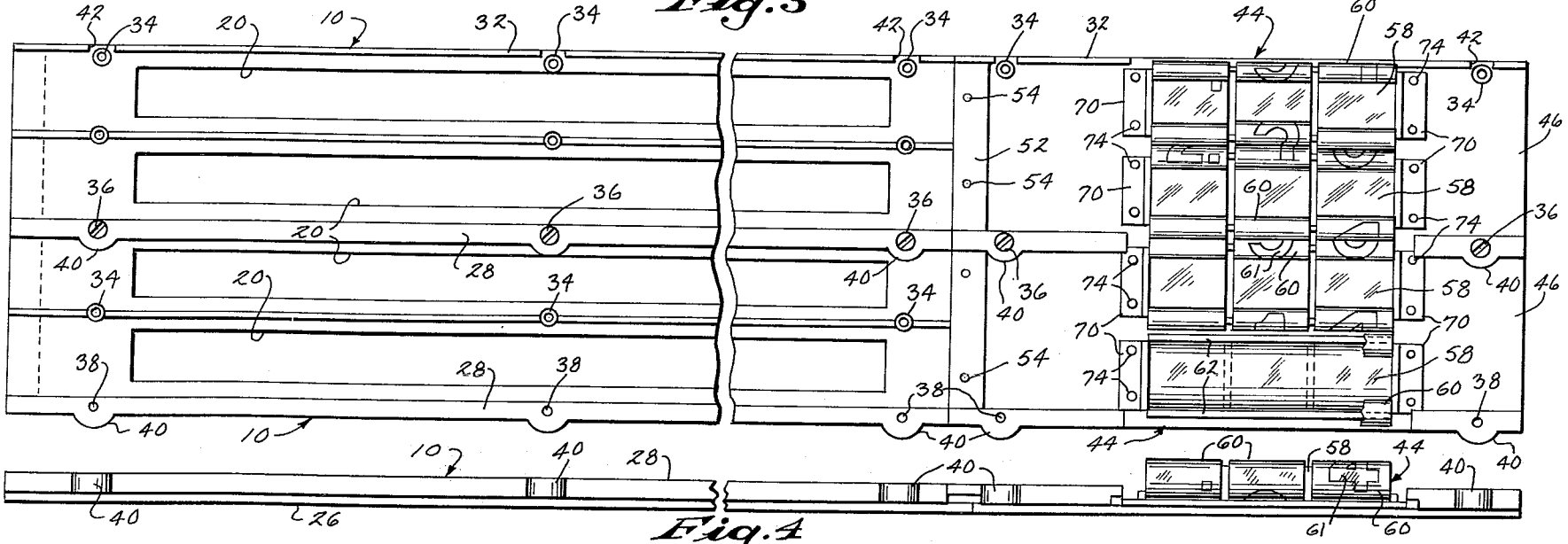
Fig. 3
Fig. 4

DISPLAY WITH INTERLOCKING STRIPS

BACKGROUND OF THE INVENTION

This invention relates to point of purchase price displays such as used in restaurants, stores, service establishments, and the like. The principal object is to provide a display which permits passage of light from a common source only through the transparent or translucent letters or numerals, which is flexible both with regard to the number of items which can be displayed and the price that is displayed for each item, and which is relatively simple and inexpensive to manufacture. Other objects and advantages of the invention will be apparent to those skilled in the art from the description herein.

SUMMARY OF THE INVENTION

A display covering a desired number of items to be listed is made by removably connecting a plurality of elongated opaque holders together at their longitudinal edges by the use of light excluding connections which block the passage of light from a common source therebehind through the connections between the holders. Each holder has at least one elongated opening therein and removable opaque strips bearing translucent indicia are attached to the holders over the elongated openings. A holder portion carrying precurled plastic film tapes is located beyond the end of each opaque strip. The indicia on the tapes is visible through window openings in the holder portion. The tapes are movably supported in side-by-side relationship on a separately formed support member having registration means which interact with registration means on the holder to register the numerals on the tapes with the window openings.

DESCRIPTION OF THE DRAWINGS

FIG. 2 is an enlarged front elevational view showing two interconnected indicia-bearing double holders used in the embodiment of FIG. 1.

FIG. 3 is an enlarged rear elevational view of the two double strips shown in FIG. 2.

FIG. 4 is a top edge view of the display shown in FIG. 2.

DESCRIPTION OF THE PREFERRED EMBODIMENT

Figure 1:
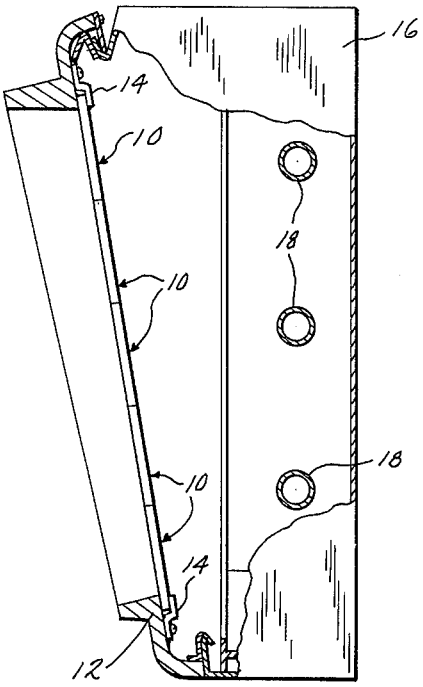
FIG. 1 is an end elevational view of one embodiment of the invention, part being broken away and shown in section.

Referring to FIG. 1, the preferred form of the invention has a plurality of interconnected opaque plastic holders 10 which are clamped behind an open rectangular frame 12 by clamps 14. Frame 12 is removably attached by conventional means to the front of the light box 16 which contains a common source of light such as fluorescent lamps 18. Frame 12 is preferably tilted at a small angle to the vertical so that the indicia on the display can be more easily read by someone standing below a wall-mounted display. While this display is commonly used with a light box, it is possible to mount the frame in front of a window and to use natural light as the common source.

Figure 5:
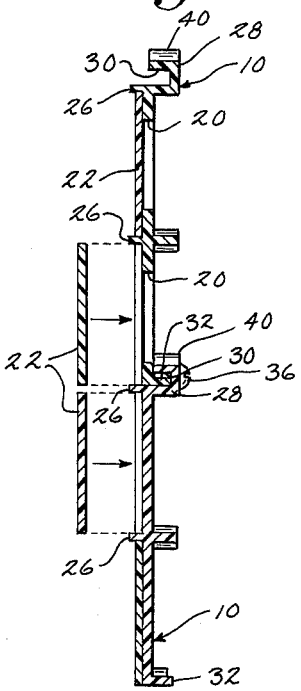
FIG. 5 is a cross-sectional view taken on the line 5—5 of FIG. 2.

As shown in FIGS. 2 and 3, each of the opaque holders 10 is preferably a double, and has two elongated openings 20 therein which are identical in size and are positioned one above the other. Opaque plastic strips 22 bearing translucent indicia 24 are attached to holders 10 over each opening 20 by the use of cement, heat sealing, ultrasonic welding, or any other suitable fastening technique. Horizontal ribs 26 (FIG. 5) project outwardly from the front surface of holders 10 and act as guides and edge supports for menu strips 22. As shown in FIG. 5, the distance between ribs 26 is only slightly greater than the height of strips 22 so that they will fit snugly between flanges 26.

Figure 6:
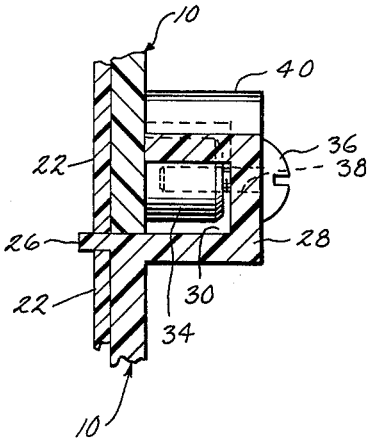
FIG. 6 is a fragmentary cross-sectional view taken on the line 6—6 of FIG. 2.
Figure 7:
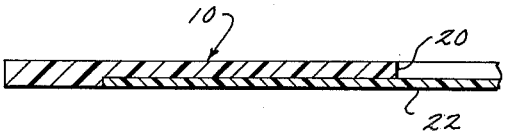
FIG. 7 is a fragmentary longitudinal sectional view taken on the line 7—7 of FIG. 2.

The top longitudinal edge of each holder 10 is molded to provide a rearwardly-offset U-shaped interlocking element 28 (FIG. 5) which forms a horizontal groove 30, and the bottom longitudinal edge of each holder 10 has a rearwardly projecting flange 32 forming a tongue for a tongue and groove connection with a groove 30, and which is dimensioned to interlock with groove 30 and to thus effectively block the passage of light at the connection between adjacent holders 10. A plurality of cylindrical, rearwardly-projecting bosses 34 (FIGS. 3 and 6) are spaced along the inner side of the flange 32 and are tapped to receive screws 36 (FIG. 6) which extend through holes 38 (FIGS. 3 and 6) in grooved portion 28 to lock the adjacent holders 10 together. Curved bulges 40 (FIG. 6) are formed on grooved portions 28 and are positioned to accommodate portions of the bosses 34 as shown in FIGS. 5 and 6 to accurately align the holders 10 one above the other as shown in FIGS. 1, 2 and 5. Openings 42 (FIG. 3) are formed in each flange 32 adjacent bosses 34 to allow room for the bosses 34.

Although each opaque holder 10 in this embodiment has two elongated openings 20 therein and two indicia-bearing strips 22 mounted thereover, it will be apparent that each holder 10 could contain only one opening 20 if desired, or more than two openings 20. The holders 10 are preferably injection molded of a suitable thermoplastic resin, and the number of openings 20 employed for each holder 10 will depend on the desired flexibility in the number of indicia-bearing strips on each display and on the size that can be accommodated by the injection molding machine. However, the same tongue 32 and groove 30, and the same bosses 34 and bulges 40 can be used to interconnect strips 10 regardless of the number of menu strip openings 20 therein.

As best shown in FIG. 2, the translucent indicia 24 are dimensioned and positioned to fit within the boundaries of openings 20 so that they will be illuminated from the rear by light from fluorescent lamps 18. In this particular embodiment, indicia 24 constitute the names of food items for sale in a restaurant. If desired, the prices of the named food items could also be marked as translucent indicia on opaque panels 22. However, for greater convenience in changing the prices without changing panels 22, a special variable indicia price unit 44 is located at the right-hand end of each holder 10 as described below.

Figure 8:
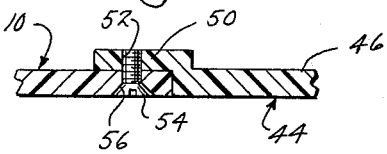
FIG. 8 is a fragmentary longitudinal sectional view taken on the line 8—8 of FIG. 2.

As shown in FIGS. 2 and 3, each variable indicia price unit 44 is preferably separately formed and has an elongated frame portion or holder 46 in which six window openings 48 are provided, three in a row, one row on top of the other, to display the price for each item marked on the strips 22. The holder has a front (where the numeral 46 is applied in FIG. 9) and has an opposite side or rear. The left-hand end of each frame 46 is offset inwardly as shown at 50 in FIG. 8, and contains threaded holes 52 for receiving flat head machine screws 54 that extend through countersunk holes 56 in the right-hand end of holder 10 to connect frames 46 thereto. The upper and lower longitudinal edges of frames 46 have like flanges, forming tongues 32 and like grooves 30, bosses 34, and bulges 40, as described above for holders 10, and are connected together by screws 36 in the same manner as holders 10. Accordingly, the frames 46 can be considered as extensions of holders 10, but could be integral therewith if desired.

Figure 9:
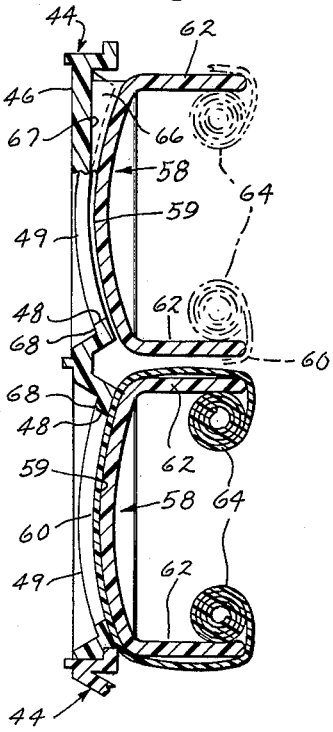
FIG. 9 is a fragmentary cross-sectional view taken on the line 9—9 of FIG. 2.
Figure 10:
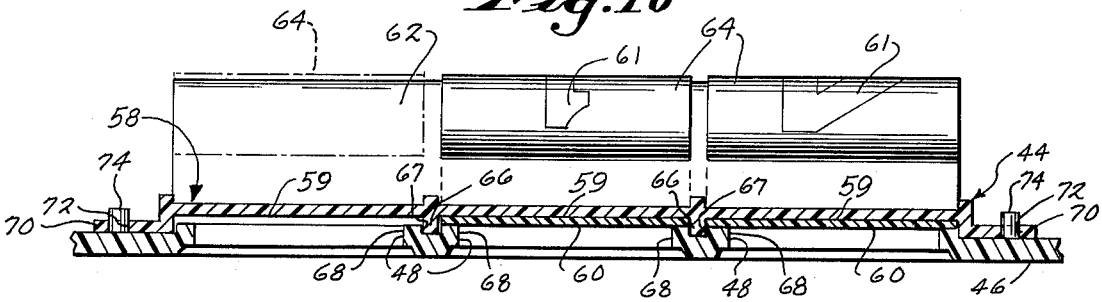
FIG. 10 is a fragmentary longitudinal sectional view taken on the line 10—10 of FIG. 2.

A translucent plastic U-shaped tape support member 58 (FIG. 9) which spans all three window openings 48 of one row (FIG. 10) is attached behind each row of window openings 48 to support three opaque, pre-curled, flexible plastic tapes 60 (FIG. 9) which have translucent digits 61 from 0 to 9 marked thereon (FIG. 2). Each U-shaped tape support member 58 has a curved tape-supporting face 59 as shown in FIG. 9 opposite portions of which form tape-guiding portions and in the illustrated embodiment these tape-guiding portions include rearwardly-projecting flanges 62 (FIG. 9) which hold the curled ends 64 of flexible plastic tapes 60 apart to permit light to pass through the face of U-shaped support member 58 and through the translucent digits 61 on tapes 60. In FIG. 9 the two adjacent tape-guiding portions 62 provide a common tape slot therebetween (where the broken lead line for the numeral 60 extends). The lateral margin of each window opening 48 is somewhat convex as at 49 (FIG. 9) to match but be spaced slightly from the curvature of the tape-supporting face 59 of the member 58 and provide tape-guiding grooves for the lateral edges of the tape. The convexity 49 causes upper and lower portions of the margin of each window opening to be curved inwardly beyond the rear face of the frame 44 and such marginal portions of two adjacent window openings provide transverse grooves 67 therebetween, one groove between each pair of window openings. Transverse guide ribs 66 (FIG. 10) project inwardly from the outer face of each support member, as shown in FIGS. 9 and 10, so that there is one guide rib 66 for each of the transverse grooves 67. This engagement between the ribs 66 and the grooves 67 insures centering of the tapes behind their respective window openings and provides means for firmly connecting the support members behind the frame, such connection being by use of plastic cement, by heat sealing, or by ultrasonic welding. Peripheral flanges 68 extend inwardly from the entire periphery of each window opening 48 to prevent the tapes 60 from buckling and to prevent vandals from grasping the edges of tapes 60 and pulling them out of the display. Each window opening also has oppositely-disposed transverse margins (where the numeral 68 is applied in FIG. 9) which are adjacent but spaced slightly from the tape-guiding portion 62 of the tape support to provide transverse slots. These slots serve as guides for guiding the tapes when the latter are being moved to change the indicia.

Each of the tape support members 58 has laterally-projecting end flanges 70 (FIG. 10) which are cemented, heat sealed, or ultrasonically welded to the rear face of frames 46. Registration holes 72 are formed in flanges 70 and are positioned to engage registration bosses 74 which project from the rear surface of frame 46 to register flexible plastic tapes 60 with their respective window openings 48.

The digits 61 which appear within window openings 48 can be easily changed by pressing a finger or thumb against the exposed surface of flexible tape 60 within a window opening 48 and moving tape 60 up or down until the desired digit 61 appears within window opening 48.

Various changes and modifications may be made without departing from the spirit of the invention, and all of such changes are contemplated as may come within the scope of the claims.

What I claim is:

1. In a display an opaque generally planar holder of finite thickness adapted to be positioned in front of a source of light, said holder having a front and having at least one window opening, said window opening having a pair of oppositely-disposed lateral margins which are convexly curved toward the front of the holder, and each window having another pair of margins which extend generally transversely of said lateral margins, a tape support subjacent said window opening and at least co-extensive therewith and including a curved tape-supporting face of light-transmitting material matingly curved with respect to the convexly curved lateral margins of the window opening, and said tape support having oppositely-disposed guiding portions subjacent said transverse window margins, means mounting said tape support in position while leaving curved tape-guiding grooves between the curved face of the tape support and the convexly curved lateral window opening margins, and also providing tape-guiding slots between said oppositely-disposed guiding portions of said tape support and said transverse margins of said window opening through which tape is guided for movement, and a pre-curled tape having a display portion with light-transmitting indicia supported on said curved face of the tape support of said window opening, with the natural curvature of the tape maintained in a position to conform to the curvature of said curved face of said tape support and to the curvature of said lateral window opening margins, said tape having a curl at each end, the oppositely-disposed guiding portions of the tape support being each engaged with one of said end curls, said end tape curls being supported in spaced relationship so that the indicia on the curved face of the tape support is exposed to the source of light, the lateral margins of said tape being overlapped by said convexly curved lateral margins of said window opening whereby the tape is shiftable by a finger inserted through a window from the front of the display while the edges of the tape are inaccessible for grasping.

2. A display as claimed in claim 1 in which the convexly curved lateral margins of said window opening have portions which curve inwardly beyond the rear of the holder.

3. A display as claimed in claim 1 in which there are two windows positioned one above the other with their transverse margins in alignment, and in which there is a tape support for each window, and in which a guiding portion of one tape support is adjacent and parallel and spaced somewhat from an adjacent guiding portion of the other tape support to provide a common guiding slot therebetween for portions of both of the tapes.

4. A display as claimed in claim 3 in which there are two rows of windows positioned one above the other with the transverse margins of one row in alignment with the transverse margins of the other row, and in which there is a tape support for each row of windows, and in which guiding portions of one tape support are adjacent and parallel and spaced somewhat from adjacent guiding portions of the other tape support to provide common guiding slots therebetween for portions of the tapes of both rows.

5. In a display an opaque generally planar holder of finite thickness adapted to be positioned in front of a source of light, said holder having a front and a rear and having a laterally-extending row of discrete window openings, each window opening having a pair of oppositely-disposed lateral margins which are convexly curved toward the front of the holder, and each window having another pair of margins which extend generally transversely of said lateral margins, a unitary tape support extending subjacent said lateral row of window openings and at least co-extensive therewith, each tape support including curved tape-supporting faces of light-transmitting material matingly curved with respect to the convexly curved lateral margins of the window openings, and said tape support having oppositely-disposed guiding portions behind the transverse window margins, means mounting said tape support in position while leaving curved tape-guiding grooves between the curved faces of the tape support and the convexly curved lateral window opening margins and also providing tape-guiding grooves between said oppositely-disposed guiding portions of said tape support and the transverse margins of the window opening through which the tape is guided for movement, and a pre-curled tape having a display portion with light-transmitting indicia supported on one of said curved tape-supporting faces within each window opening, with the natural curvature of the tape maintained in a position to conform to the curvature of the tape-supporting face and to the curvature of said lateral window opening margins, each tape having a curl at each end, the oppositely-disposed guiding portions of the tape support being each engaged with one of said tape curls, said tape curls being supported in spaced relationship so that the indicia on the curved tape-supporting faces are exposed to the source of light, the lateral margins of each tape being overlapped by said convexly curved lateral margins of its window opening whereby each tape is shiftable by a finger inserted through a window from the front of the display while the edges of the tape are inaccessible for grasping.

6. A display as claimed in claim 5 in which the convexly curved lateral margins of each window opening have portions which curve inwardly beyond the rear of the holder.

7. A display as claimed in claim 6 in which said marginal portions of a window opening which curve inwardly beyond the rear of the holder are spaced laterally from like marginal portions of an adjacent window opening to provide a groove therebetween, and in which the tape support has ribs engaged with said grooves to align the tapes with the windows.

* * * * *